US010167533B2

(12) United States Patent
Kawasaki et al.

(10) Patent No.: US 10,167,533 B2
(45) Date of Patent: Jan. 1, 2019

(54) WEAR-RESISTANT COPPER-BASED ALLOY, CLADDING ALLOY, CLADDING LAYER, AND VALVE SYSTEM MEMBER AND SLIDING MEMBER FOR INTERNAL COMBUSTION ENGINE

(71) Applicants: TOYOTA JIDOSHA KABUSHIKI KAISHA, Toyota-shi, Aichi-ken (JP); KABUSHIKI KAISHA TOYOTA CHUO KENKYUSHO, Nagakute-shi, Aichi-ken (JP)

(72) Inventors: Minoru Kawasaki, Toyota (JP); Nobuyuki Shinohara, Tajimi (JP); Takehisa Fujita, Nisshin (JP); Hironori Aoyama, Toyota (JP); Yasuhiro Yamamoto, Chiryu (JP); Tadashi Oshima, Nagakute (JP); Hajime Kato, Nagakute (JP); Kouji Tanaka, Nagakute (JP); Takashi Saito, Nagakute (JP)

(73) Assignees: TOYOTA JIDOSHA KABUSHIKI KAISHA, Toyota (JP); KABUSHIKI KAISHA TOYOTA CHUO KENKYUSHO, Nagakute (JP)

( * ) Notice: Subject to any disclaimer, the term of this patent is extended or adjusted under 35 U.S.C. 154(b) by 219 days.

(21) Appl. No.: 15/231,051

(22) Filed: Aug. 8, 2016

(65) Prior Publication Data

US 2017/0037495 A1 Feb. 9, 2017

(30) Foreign Application Priority Data

Aug. 7, 2015 (JP) ..... 2015-157584

(51) Int. Cl.

| | |
|---|---|
| ***C22C 9/06*** | (2006.01) |
| ***C22C 32/00*** | (2006.01) |
| ***F01L 5/24*** | (2006.01) |
| ***F01L 3/02*** | (2006.01) |

(52) U.S. Cl.

CPC ..... *C22C 9/06* (2013.01); *C22C 32/0052* (2013.01); *F01L 3/02* (2013.01); *F01L 5/24* (2013.01); *F01L 2101/00* (2013.01); *F01L 2103/00* (2013.01)

(58) Field of Classification Search

CPC ..... C22C 9/00; C22C 9/06; C22C 32/0052; F01L 3/02; F01L 3/04; F01L 5/24; F01L 2103/00; F01L 2101/00

See application file for complete search history.

(56) References Cited

U.S. PATENT DOCUMENTS

| | | | |
|---|---|---|---|
| 4,818,307 A | 4/1989 | Mori et al. | |
| 5,188,799 A | 2/1993 | Mori et al. | |
| 5,843,243 A | 12/1998 | Kawasaki et al. | |
| 5,911,949 A | 6/1999 | Ninomiya et al. | |
| 2004/0045641 A1 | 3/2004 | Kawasaki et al. | |
| 2017/0253950 A1* | 9/2017 | Shinohara | C22C 9/06 |

FOREIGN PATENT DOCUMENTS

| | | |
|---|---|---|
| EP | 1361288 A1 | 11/2003 |
| JP | H04-297536 A | 10/1992 |
| JP | H08-225868 A | 9/1996 |
| JP | H10-96037 A | 4/1998 |
| JP | 2006-098085 A | 4/2006 |
| JP | 4114922 B2 | 7/2008 |
| WO | 02/055748 A1 | 7/2002 |

* cited by examiner

*Primary Examiner* — C Melissa Koslow
(74) *Attorney, Agent, or Firm* — Oliff PLC

(57) ABSTRACT

A wear-resistant copper-based alloy includes: at least one selected from the group made of molybdenum, tungsten, and vanadium and niobium carbide; chromium in an amount of less than 1.0% in terms of wt %; and a matrix and hard particles dispersed in the matrix, in which the hard particles include niobium carbide and at least one selected from the group made of Nb—C—Mo, Nb—C—W, and Nb—C—V around the niobium carbide.

9 Claims, 5 Drawing Sheets

WEAR-RESISTANT COPPER-BASED ALLOY, CLADDING ALLOY, CLADDING LAYER, AND VALVE SYSTEM MEMBER AND SLIDING MEMBER FOR INTERNAL COMBUSTION ENGINE

INCORPORATION BY REFERENCE

The disclosure of Japanese Patent Application No. 2015-157584 filed on Aug. 7, 2015 including the specification, drawings and abstract is incorporated herein by reference in its entirety.

BACKGROUND OF THE INVENTION

1. Field of the Invention

The present invention relates to a wear-resistant copper-based alloy, a cladding alloy, a cladding layer, and a valve system member and a sliding member for an internal combustion engine.

2. Description of Related Art

In order to avoid a problem of adhesion, a copper-based alloy is subjected to a certain surface treatment such as forming an oxide film on the surface of a metal. For example, under friction and wear conditions at a high temperature of higher than 200° C., there is a high probability of adhesive wear occurs due to contact between metals which are formed of materials with particularly low melting points. However, such a surface treatment is generally performed in a typical heat treatment process, and there is a problem in that time and production costs are needed.

Particularly in a case where a copper-based alloy is used as a cladding material of an exhaust valve seat for an ethanol-containing fuel such as gasoline, the copper-based alloy is placed in a reducing atmosphere in which a reduction action of hydrogen strongly works. Therefore, the formation of an oxide film formed of any one of molybdenum, tungsten, and vanadium, which contribute to wear resistance, niobium carbide, and the like is not promoted, and adhesive wear easily occurs due to contact between metals. When wear resistance decreases as described above, there may be a case where wear occurs to a degree beyond the limit that the valve seat functions.

In a case of adding chromium for the purpose of improving corrosion resistance, a chromium passive oxide film is formed on the surface of a copper-based alloy material and thus corrosion resistance is improved. However, an oxide film formed of niobium carbide and molybdenum and the like is less likely to be formed on the surface of the metal, and there is a problem in that wear resistance decreases.

For example, Japanese Patent Application Publication No. 8-225868 (JP 8-225868 A) discloses a wear-resistant copper-based alloy which contains 1.0% to 10.0% of chromium, and Japanese Patent No. 4114922 discloses a wear-resistant copper-based alloy containing 1.0% to 15.0% of chromium. In a wear-resistant copper alloy disclosed in Japanese Patent Application Publication No. 4-297536 (JP 4-297536 A), in a case of including chromium, it is considered that it is preferable to include chromium in a proportion of 1.0% to 10.0% in order to obtain the effect thereof. Similarly, in a wear-resistant copper alloy disclosed in Japanese Patent Application Publication No. 10-96037 (JP 10-96037 A), in a case of including chromium, it is considered that it is preferable to include chromium in a proportion of 1.0% to 10.0% in order to improve wear resistance.

SUMMARY OF THE INVENTION

As in the wear-resistant copper alloys disclosed in JP 4-297536 A and JP 10-96037 A, in a case where Nb is added as a single element, hard particles form a Laves phase as MoFe silicide or NbFe silicide and exhibit hardness. Therefore, silicon (Si) becomes insufficient in a base, and there is concern that adhesion resistance may decrease. As described above, in consideration of the improvement in corrosion resistance and the like, a predetermined amount of chromium or more is added to the copper-based alloy. Accordingly, the formability of the oxide film formed of niobium carbide and molybdenum and the like is degraded, resulting in insufficient wear resistance and insufficient lubricity.

The present invention provides a copper-based alloy having excellent wear resistance.

The inventors found that by including niobium carbide and at least one selected from the group consisting of molybdenum, tungsten, and vanadium in a copper-based alloy as essential elements and causing the amount of chromium to be less than 1.0%, an oxide film is easily formed on the surface of a metal, and by imparting desired oxidation properties thereto, wear resistance can be improved.

According to a first aspect of the present invention, there is provided a wear-resistant copper-based alloy including: at least one selected from the group consisting of molybdenum, tungsten, and vanadium and niobium carbide; chromium in an amount of less than 1.0% in terms of wt %; and a matrix and hard particles dispersed in the matrix, in which the hard particles include niobium carbide and at least one selected from the group consisting of Nb—C—Mo, Nb—C—W, and Nb—C—V around the niobium carbide.

In the wear-resistant copper-based alloy according to the first aspect, each of the elements is distributed in a specific form, thereby achieving desired oxidation properties and excellent wear resistance. It was found that the formability of film of Nb—C—Mo oxide, Nb—C—W oxide, and Nb—C—V oxide which are present around NbC is significantly affected by the presence of chromium. Therefore, by causing the amount of chromium to be less than 1.0% in terms of wt %, an oxide film is easily formed on the surface of a metal, and excellent wear resistance can be obtained.

The wear-resistant copper-based alloy may include, in terms of wt %: nickel: 5.0% to 30.0%; silicon: 0.5% to 5.0%; iron: 3.0% to 20.0%; chromium: less than 1.0%; niobium carbide: 0.01% to 5.0%; at least one selected from the group consisting of molybdenum, tungsten, and vanadium: 3.0% to 20.0%; copper as a balance; and unavoidable impurities. The reason for limiting each of the components will be described later. However, chromium among the components is most easily oxidized. Therefore, by causing the amount of chromium to be less than 1.0% in terms of wt %, better wear resistance can be obtained.

The wear-resistant copper-based alloy may not include chromium. Accordingly, the inhibition of the generation of an oxide film formed of niobium carbide and molybdenum and the like due to chromium is suppressed, and excellent wear resistance can be obtained.

In the wear-resistant copper-based alloy, the amount of chromium may be more than 0% and less than 1.0%. Accordingly, corrosion resistance is ensured by the formation of a chromium passive oxide film, and the inhibition of the generation of an oxide film formed of niobium carbide and molybdenum and the like due to chromium is suppressed, thereby obtaining excellent wear resistance.

In the wear-resistant copper-based alloy, an amount of cobalt may be less than 2.0%. By causing the amount of cobalt to be less than 2.0%, a reduction in cracking resistance can be prevented.

In a case where the amount of cobalt is less than 2.0% and the amount of molybdenum is 10% or less, a reduction in cracking resistance can be prevented.

The wear-resistant copper-based alloy may be used as a cladding alloy. By using the copper-based alloy of the present invention for cladding, the cladding alloy having excellent wear resistance can be obtained.

According to a second aspect of the present invention, there is provided a cladding layer which is made of the wear-resistant copper-based alloy according to the first aspect. By forming the cladding layer using the copper-based alloy according to the first aspect, the cladding layer having excellent wear resistance can be obtained.

According to a third aspect of the present invention, there is provided a valve system member or sliding member for an internal combustion engine, which is made of the wear-resistant copper-based alloy according to the first aspect. By forming the valve system member or sliding member using the wear-resistant copper-based alloy according to the first aspect, the valve system member or sliding member having excellent wear resistance can be obtained.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A copper-based alloy of an embodiment of the present invention includes, as essential elements, niobium carbide and at least one selected from the group consisting of molybdenum, tungsten, and vanadium (hereinafter, referred to as molybdenum and the like), and includes chromium in an amount of less than 1.0% in terms of wt %, each of the elements being distributed in a specific form, thereby achieving desired oxidation properties and excellent wear resistance. The formability of a film of Nb—C—Mo oxide, Nb—C—W oxide, and Nb—C—V oxide which are present around NbC is significantly affected by the presence of chromium. Therefore, by causing the amount of chromium to be less than 1.0% in terms of wt %, an oxide film is easily formed on the surface of a metal, and excellent wear resistance can be obtained.

From the viewpoint of obtaining desired properties, which will be described later, it is preferable that the copper-based alloy of the embodiment includes, in terms of wt %: nickel (Ni): 5.0% to 30.0%; silicon (Si): 0.5% to 5.0%; iron (Fe): 3.0% to 20.0%; chromium (Cr): less than 1.0%; niobium carbide (NbC): 0.01% to 5.0%; at least one selected from the group consisting of molybdenum (Mo), tungsten (W), and vanadium (V): 3.0% to 20.0%; copper (Cu) as a balance; and unavoidable impurities.

Figure 1A:
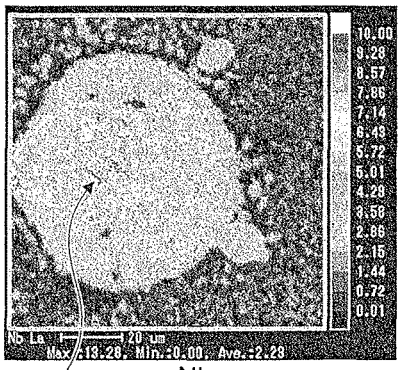
FIG. 1A is a view showing element mapping results through electron probe micro-analyzer (EPMA) analysis in an embodiment of a copper-based alloy, and is view showing mapping results of Nb.
Figure 1B:
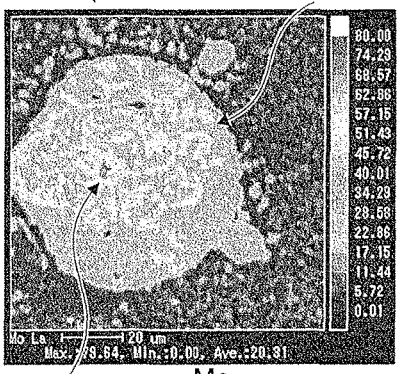
FIG. 1B is a view showing element mapping results through electron probe micro-analyzer (EPMA) analysis in an embodiment of a copper-based alloy, and is view showing mapping results of Mo.
Figure 1C:
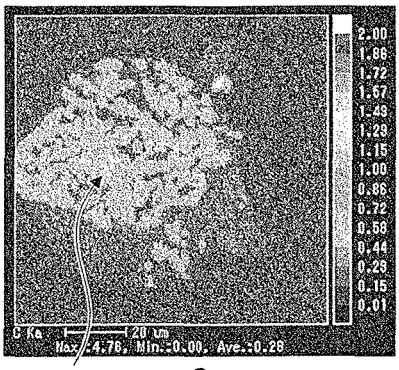
FIG. 1C is a view showing element mapping results through electron probe micro-analyzer (EPMA) analysis in an embodiment of a copper-based alloy, and is view showing mapping results of C.
Figure 1D:
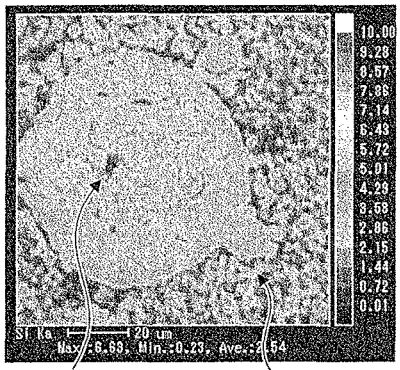
FIG. 1D is a view showing element mapping results through electron probe micro-analyzer (EPMA) analysis in an embodiment of a copper-based alloy, and is view showing mapping results of Si.
Figure 1E:
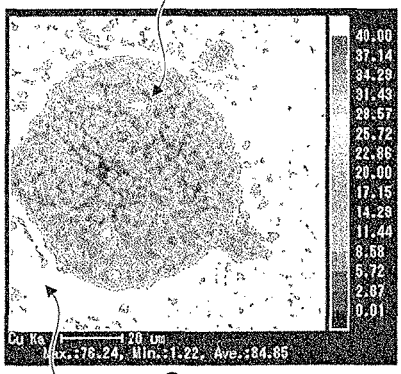
FIG. 1E is a view showing element mapping results through electron probe micro-analyzer (EPMA) analysis in an embodiment of a copper-based alloy, and is view showing mapping results of Cu.
Figure 1F:
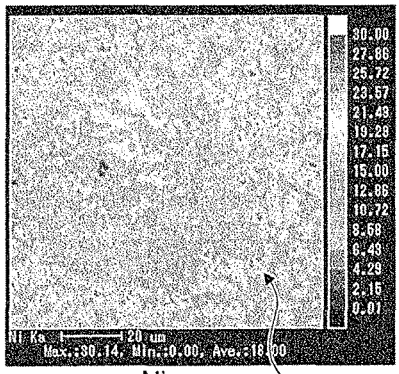
FIG. 1F is a view showing element mapping results through electron probe micro-analyzer (EPMA) analysis in an embodiment of a copper-based alloy, and is view showing mapping results of Ni.

The copper-based alloy of the embodiment will be described with reference to FIGS. 1A to 1F. FIGS. 1A to 1F show element mapping results in the embodiment of the copper-based alloy. In the embodiment of the copper-based alloy, molybdenum is present in a large proportion in a portion of niobium carbide NbC (FIG. 1A) having an action of generating nuclei in hard particles. Specifically, molybdenum is present in the form of a complex carbide of Nb and Mo, Nb—C—Mo (see FIGS. 1B and 2). Around NbC, silicon is not present (FIG. ID), and carbon is present in the portion (FIG. 1C). In a copper-based material, Si and Ni form a mesh-like nickel silicide structure (FIGS. 1D, 1E, and 1F).

The reason for limiting each of the components associated with the wear-resistant copper-based alloy according to the embodiment of the present invention is described.

Nickel (Arbitrary Component): 5.0% to 30.0%

A portion of nickel is solutionized into copper and improves the toughness of a copper-based matrix, and the other portion is dispersed to form a hard silicide including nickel as a primary component and increases wear resistance. Nickel forms a mesh-like nickel silicide reinforcing layer in a copper-based material with silicon, which is excluded from a region where a carbon region is formed around NbC in the hard particles, and improves the adhesion resistance of the base material. In addition, nickel forms a hard phase of the hard particles along with iron, molybdenum, and the like. Due to a balance with silicon excluded from the carbon region in the hard particles, the upper limit of the amount of nickel is set to 30.0%, may also be exemplified as 25.0% or 20.0%, and is not limited thereto. From the viewpoint of ensuring properties of a copper-nickel-based alloy, particularly good corrosion resistance, heat resistance, and wear resistance, ensuring toughness by sufficiently generating hard particles, suppressing the generation of cracks when a cladding layer is formed, and maintaining cladding properties regarding an object in a case of further performing cladding, the lower limit of the amount of nickel is set to 5.0%, may be exemplified as 10.0% or 15.0%, and is not limited thereto. In consideration of the above-described circumstances, the amount of nickel in the copper-based alloy of the embodiment may be set to 5.0% to 30.0%, preferably 10% to 25%, and more preferably 15% to 20%.

Silicon (Arbitrary Component): 0.5% to 5.0%

Silicon is an element that forms a silicide, and forms a silicide including nickel as a primary component or a silicide including molybdenum (tungsten or vanadium) as a primary component, thereby contributing to strengthening of the copper-based matrix. In a case where the amount of the nickel silicide is low, the adhesion resistance of the base material decreases. In addition, the silicide including molybdenum (tungsten or vanadium) as a primary component has a function of maintaining high-temperature lubricity of the copper-based alloy of the embodiment. From the viewpoint of ensuring toughness by sufficiently generating hard particles, suppressing the generation of cracks when a cladding layer is formed, and maintaining cladding properties regarding an object in a case of further performing cladding, the upper limit of the amount of silicon is set to 5.0%, may be exemplified as 4.5% or 3.5%, and is not limited thereto. From the viewpoint of sufficiently obtaining the above-described effects, the lower limit of the amount of silicon is set to 0.5%, may be exemplified as 1.5% or 2.5%, and is not limited thereto. In consideration of the above-described circumstances, the amount of silicon in the copper-based alloy of the embodiment of the present invention may be set to 0.5% to 5.0%, preferably 1.5% to 4.5%, and more preferably 2.5% to 3.5%.

Iron (Arbitrary Component): 3.0% to 20.0%

Iron is rarely solutionized in the copper-based matrix and is present in a portion outside the surrounding portion of NbC in the hard particles primarily as a Fe—Mo-based, Fe—W-based, or Fe—V-based silicide. The Fe—Mo-based, Fe—W-based, or Fe—V-based silicide has lower hardness and slightly higher toughness than those of a Co—Mo-based silicide. From the viewpoint of obtaining wear resistance by sufficiently generating hard particles, the upper limit of the amount of iron is set to 20.0%, may be exemplified as 15.0% or 10.0%, and is not limited thereto. From the viewpoint of obtaining wear resistance by sufficiently generating hard particles, the lower limit of the amount of iron is set to 3.0%, may be exemplified as 5.0% or 7.0%, and is not limited thereto. In consideration of the above-described circumstances, the amount of iron in the copper-based alloy of the embodiment may be set to 3.0% to 20.0%, preferably 5.0% to 15.0%, and more preferably 7.0% to 10.0%.

Chromium: Less than 1.0%

Among the components that may be contained in the copper-based alloy of the embodiment, from an Ellingham diagram (for example, refer to http://www.doitpoms.ac.uk/tlplib/ellingham_diagrams/interactive.php) that shows the ease of oxidation, chromium is most easily oxidized. NbCMo which is present around NbC has a higher degree of inhibiting the formation of an oxide film due to the presence of chromium than FeMoSi. When the amount of chromium is high, a small amount of oxygen is consumed by chromium, which inhibits the oxidation of molybdenum and the like, and inhibits the formation of an oxide film of molybdenum and the like. Wear resistance is ensured by an oxide film of molybdenum and the like on the surface of the hard particle. Therefore, when the amount of chromium is high, wear resistance decreases. Therefore, the amount of chromium is set to be less than 1.0%, and the upper limit of the amount thereof may be exemplified as 0.8%, 0.6%, 0.4%, 0.1%, or 0.001% and is not limited thereto. From the above-described viewpoint, it is preferable that the copper-based alloy of the embodiment does not contain chromium.

Niobium Carbide: 0.01% to 5.0%

Niobium carbide has an action of generating nuclei in hard particles, achieves refinement of the hard particles, and thus contributes to the compatibility between cracking resistance and wear resistance. Niobium carbide forms a carbon region in the hard particles, and thus silicon is excluded from the region. Therefore, the amount of the mesh-like nickel silicide reinforcing layer in the copper-based material is increased, and thus the adhesion resistance of the base material is improved. Contrary to this, in a case where niobium is added in the form of a single element, not niobium carbide, niobium exhibits the same effects as those of molybdenum and the like, forms a Laves phase of MoFe silicide or NbFe silicide in the hard particles, and thus shows different actions from those of niobium in the copper-based alloy of the embodiment. In order to avoid the inhibition of cracking resistance, the upper limit of the amount of niobium carbide is set to 5.0%, may be exemplified as 4.0%, 3.0%, 2.0% or 1.0%, and is not limited thereto. From the viewpoint of obtaining an effect of improving the refinement of the hard particles through the addition of niobium carbide, the lower limit of the amount of niobium carbide is set to 0.01%, may be exemplified as 0.1%, 0.3%, 0.6%, and is not limited thereto. In consideration of the above-described circumstances, the amount of niobium carbide in the copper-based alloy of the embodiment may be set to 0.01% to 5.0%, preferably 0.1% to 2.0%, and more preferably 0.6% to 1.0%.

At Least One Selected from the Group Consisting of Molybdenum, Tungsten, and Vanadium: 3.0% to 20.0%

Molybdenum is present as NbCMo around NbC. NbCMo has a higher degree of inhibiting the formability of an oxide film due to the presence of chromium than FeMoSi. Therefore, in the copper-based alloy of the embodiment in which chromium is included in the above-described range, the degree of inhibiting the formation of an oxide film which contributes to wear resistance is significantly reduced, and the oxide film is easily formed. Therefore, desired oxidation properties are provided. Specifically, this oxide covers the surface of the copper-based matrix during use and is useful to avoid direct contact between a counter material and the matrix. Accordingly, self-lubricity is ensured. Tungsten and vanadium basically have the same function as that of molybdenum. In addition, molybdenum is bonded to silicon and forms a silicide (an Fe—Mo-based silicide having toughness outside the surrounding portion of NbC) in the hard particles, thereby increasing wear resistance and lubricity at high temperatures. The silicide has lower hardness and higher toughness than those of the Co—Mo-based silicide. The silicide is generated in the hard particles and increases wear resistance and lubricity at high temperatures. In order to avoid an excessive increase in the amount of the hard particles, a reduction in toughness and cracking resistance, and the ease of generation of cracks, the upper limit of the amount of molybdenum and the like is set to 20.0%, may be exemplified as 15.0%, 10.0%, or 8.0% and is not limited thereto. From the viewpoint of ensuring wear resistance by sufficiently generating hard particles, the lower limit of the amount of molybdenum and the like is set to 3.0%, may be exemplified as 4.0%, 5.0%, or 6.0%, and is not limited thereto. In consideration of the above-described circumstances, the amount of molybdenum and the like in the copper-based alloy of the embodiment may be set to 3.0% to 20.0%, preferably 4.0% to 10.0%, and more preferably 5.0% to 8.0%. As described later, in a case where the copper-based alloy of the embodiment contains cobalt, cobalt is contained in an amount of preferably less than 2.0%, and more preferably less than 0.01%. It is particularly preferable that cobalt is not contained. In this case, it is preferable to ensure toughness by increasing the amount of molybdenum and the like being added. In this case, from the viewpoint of avoiding a reduction in cracking resistance, the upper limit of the amount of molybdenum and the like is preferably set to 10%.

Cobalt (Arbitrary Component): Less than 2.0%

Figure 4:
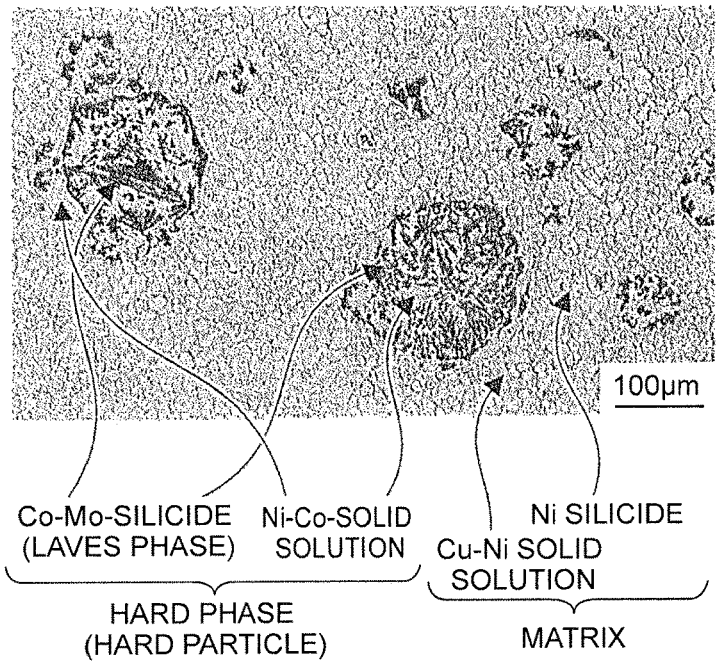
FIG. 4 is an explanatory view showing a micrograph of a cladding layer formed by using a copper-based alloy of Comparative Example 8.

Cobalt in an amount of up to 2.00% forms a solid solution with nickel, iron, chromium, and the like and improves toughness. In a case where the amount of cobalt is high, cobalt is incorporated into the nickel silicide structure, resulting in a reduction in cracking resistance (FIG. 4). Therefore, from the viewpoint of avoiding this, the amount of cobalt is set to be less than 2.0% and preferably less than 0.01%, and the upper limit thereof may be exemplified as 1.5%, 1.0%, or 0.5%, and is not limited thereto. From this viewpoint, it is particularly preferable that copper-based alloy of the embodiment does not contain cobalt.

An example of the wear-resistant copper-based alloy according to the embodiment will be described below.

The wear-resistant copper-based alloy according to the embodiment may be used as a cladding alloy for cladding an object. As a cladding method, a method of performing cladding through deposition using a high-density energy heat source such as a laser beam, electron beam, or arc may be employed. In a case of cladding, the wear-resistant copper-based alloy according to the embodiment is formed into a powder to be used as a cladding material, and in a state in which the powder is fed to a portion to be clad, cladding may be performed through deposition using the high-density energy heat source such as a laser beam, electron beam, or arc. The wear-resistant copper-based alloy is not limited to the form of a powder and may be used in the form of a wire-shaped or bar-shaped cladding material. Examples of the laser beam include laser beams having a high energy density such as a carbon dioxide laser beam and a YAG laser beam. Examples of the material of the object to be clad include aluminum, an aluminum-based alloy, iron, an iron-based alloy, copper, and a copper-based alloy. Examples of the basic composition of an aluminum alloy contained in the object include casting aluminum alloys such as Al—Si-based, Al—Cu-based, Al—Mg-based, and Al—Zn-based alloys. Examples of the object include an engine such as an internal combustion engine. In a case of an internal combustion engine, a valve system material is exemplified. In this case, the wear-resistant copper-based alloy may be applied to a valve seat included in an exhaust port, or a valve seat included in an intake port. In this case, the valve seat itself may be formed of the wear-resistant copper-based alloy according to the embodiment, or the valve seat may be clad with the wear-resistant copper-based alloy of the embodiment. However, the wear-resistant copper-based alloy according to the embodiment is not limited to a valve system material of an engine such as an internal combustion engine and may also be used for a sliding material of another system which requires wear resistance, a sliding member, or a sintered product. The wear-resistant copper-based alloy according to the embodiment does not contain zinc or tin as an active element, and thus can suppress the generation of fume even in a case of cladding. The wear-resistant copper-based alloy according to the embodiment does not contain aluminum as an active element, and thus suppresses the generation of a compound of Cu and Al such that ductility can be maintained.

In a case where the wear-resistant copper-based alloy according to the embodiment is used for cladding, the wear-resistant copper-based alloy may form a cladding layer after the cladding or may be used as a cladding alloy before the cladding.

The wear-resistant copper-based alloy according to the embodiment may be applied to, for example, a copper-based sliding member or sliding portion. Specifically, the wear-resistant copper-based alloy may also be applied to a copper-based valve system material mounted in an internal combustion engine. The wear-resistant copper-based alloy according to the embodiment may be used for cladding, casting, and sintering.

Hereinafter, the present invention will be described according to Examples, and the present invention is not limited to the scope of Examples.

Examples 1 to 3 and Comparative Examples 1 to 7 and 8 to 10

The compositions (mixing compositions) of wear-resistant copper-based alloys of Examples 1 to 3 and copper-based alloys of Comparative Examples 1 to 7 are shown in Table 1.

Comparative Example 8 corresponds to the copper-based alloy disclosed in JP 4-297536 A. Comparative Example 9 corresponds to the copper-based alloy disclosed in JP 8-225868 A. Comparative Example 10 corresponds to the copper-based alloy disclosed in Japanese Patent No. 4114922. The components of the wear-resistant copper-based alloys of Examples 1 to 3 and the copper-based alloys Comparative Examples 1 to 7 are shown in Table 1.

TABLE 1

| | Component (wt %) | | | | | | | |
|---|---|---|---|---|---|---|---|---|
| | Cr | Cu | Ni | Si | Mo | Fe | Nb | C |
| Example 1 | 0.00 | 62.649 | 17.800 | 2.960 | 6.060 | 9.550 | 0.790 | 0.070 |
| Example 2 | 0.25 | 62.492 | 17.756 | 2.953 | 6.045 | 9.526 | 0.788 | 0.070 |
| Example 3 | 0.75 | 62.179 | 17.667 | 2.938 | 6.015 | 9.478 | 0.784 | 0.069 |
| Comparative Example 1 | 1.00 | 62.023 | 17.622 | 2.930 | 5.999 | 9.455 | 0.782 | 0.069 |
| Comparative Example 2 | 1.50 | 61.709 | 17.533 | 2.916 | 5.969 | 9.407 | 0.778 | 0.069 |
| Comparative Example 3 | 2.00 | 61.396 | 17.444 | 2.901 | 5.939 | 9.359 | 0.774 | 0.069 |

TABLE 1-continued

| | Component (wt %) | | | | | | | |
|---|---|---|---|---|---|---|---|---|
| | Cr | Cu | Ni | Si | Mo | Fe | Nb | C |
| Comparative Example 4 | 2.50 | 61.083 | 17.355 | 2.886 | 5.909 | 9.311 | 0.770 | 0.068 |
| Comparative Example 5 | 3.00 | 60.770 | 17.266 | 2.871 | 5.878 | 9.264 | 0.766 | 0.068 |
| Comparative Example 6 | 5.00 | 59.517 | 16.910 | 2.812 | 5.757 | 9.073 | 0.751 | 0.067 |
| Comparative Example 7 | 10.00 | 56.384 | 16.020 | 2.664 | 5.454 | 8.595 | 0.711 | 0.063 |

The wear-resistant copper-based alloys of Examples 1 to 3 and the copper-based alloys of Comparative Examples 1 to 7 and 8 to 10 were powders produced by mixing components in the corresponding compositions and performing a gas atomization treatment on molten alloys melted in a high vacuum. The particle size of the powders was 5 μm to 300 μm. The gas atomization treatment was performed by forcing molten metal at a high temperature through a nozzle into a non-oxidizing atmosphere (argon gas or nitrogen gas atmosphere). Since the powder is formed through the gas atomization treatment, the powder has high component uniformity.

The cladding layer was formed in the same manner as that in the method described in Japanese Patent No. 4114922.

A substrate formed of an aluminum alloy (material: AC2C) as a cladding object was used, and in a state in which the sample was placed on a portion to be clad in the substrate and formed a powder layer, a laser beam of a carbon dioxide laser was oscillated by a beam oscillator. In addition, by relatively moving the laser beam and the substrate, the powder layer was irradiated with the laser beam. The powder layer was then melted and solidified such that a cladding layer (cladding thickness: 2.0 mm, and cladding width: 6.0 mm) was formed on the portion to be clad in the substrate. At this time, a shielding gas (argon gas) was blown toward the cladding point from a gas supply tube. During the irradiation process, the laser beam was oscillated in the width direction of the powder layer by the beam oscillator. During the irradiation process, the laser output of the carbon dioxide laser was set to 4.5 kW, the spot diameter of the laser beam on the powder layer was set to 2.0 mm, the travelling speed of the laser beam relative to the substrate was set to 15.0 mm/sec, and the flow rate of the shielding gas was set to 10 lit/min.

<Oxidation Test>

(1) Sample Preparation

For each of the copper-based alloys, a sample processed into a rectangular parallelepiped shape with a sample shape of 10 mm in length×10 mm in width×1 mm in thickness was prepared.

(2) Weight Measurement

The initial weight of the sample was measured.

(3) Heating

The sample was held in an electric furnace heated to 500° C. for 100 hours.

(4) Weight Measurement

The weight of the sample after heating was measured.

(5) Calculation of Rate of Increase in Weight

The rate of increase in weight was calculated from the following expression: rate of increase in weight=(weight after heating−initial weight)/initial weight×100(%) using the measurement results of (2) and (4).

Figure 3:
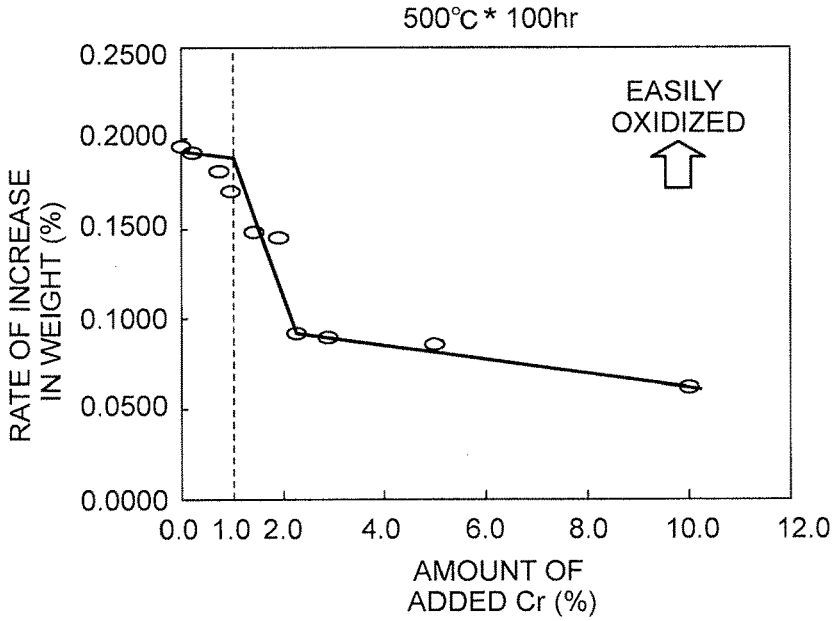
FIG. 3 is a graph showing the relationship between the amount of added chromium and the rate of increase in weight in an oxidation test.

The test results of the wear-resistant copper-based alloys of Examples 1 to 3 and the copper-based alloys of Comparative Examples 1 to 7 are shown in FIG. 3. It can be seen from FIG. 3 that oxidation properties are improved in a case where the amount of chromium is less than 1.0% in terms of wt %.

<Wear Test>

Figure 5:
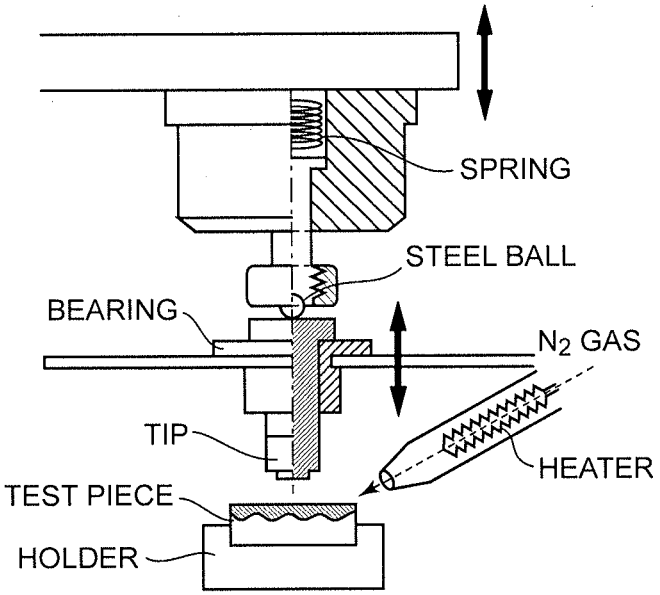
FIG. 5 is a view schematically illustrating a state in which a wear resistance test is conducted on a test piece having a cladding layer.

Wear resistance was measured using a repeated hammering type adhesive wear tester illustrated in FIG. 5. The tester was of a type in which, in consideration of an operation between a valve and a valve seat, a high-temperature inert gas was blown toward a test piece contact surface so as to be heated and in the meanwhile, the surface was repeatedly hammered by the tip of a columnar counter member. The counter member was rotated at about 1 rpm. In the tester, a heater for heating the blown gas was controlled by a thermocouple adhered to the end portion of the test piece such that the temperature of the contact surface was controlled. Adhesion resistance was measured by the weight of a seat material adhered to the counter member. Specific test conditions are as follows.

TABLE 2

| | |
|---|---|
| Maximum load (MPa) | 9.8 |
| Hitting frequency (Hz) | 16.7 |
| Time (ks) | 3.6 |
| Counter member | SUH35* |

*Fe—21Cr—9Mn—4Ni—0.5C

Figure 6:
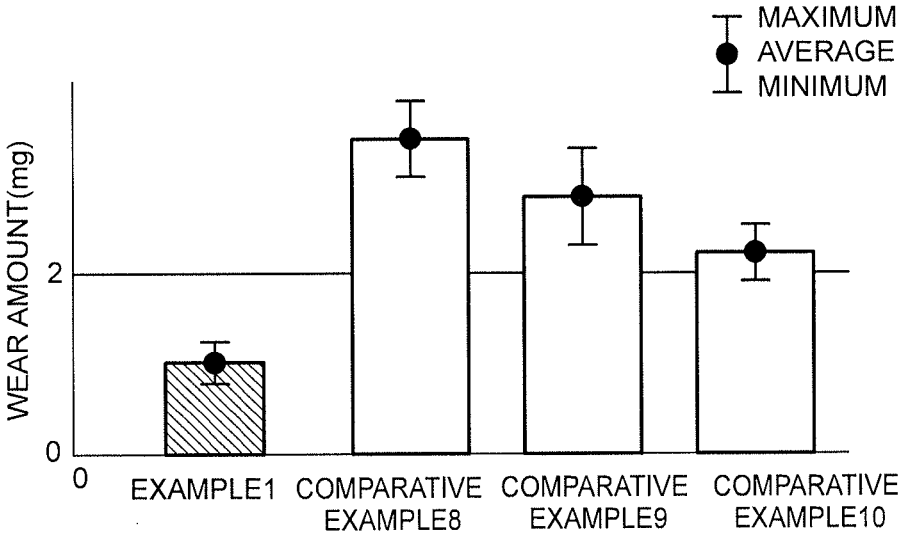
FIG. 6 is a graph showing a comparison (test temperature 600° C.) in wear amount between copper-based alloys of Example 1 and Comparative Examples 8 to 10.
Figure 7:
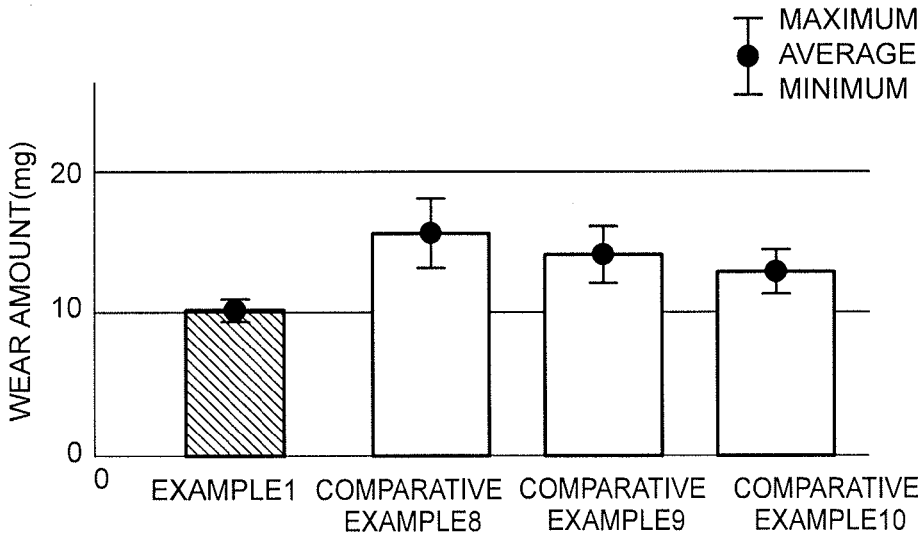
FIG. 7 is a graph showing a comparison (test temperature: 230° C. at a contact surface) in wear amount between the copper-based alloys of Example 1 and Comparative Examples 8 to 10.

The test results of the wear-resistant copper-based alloy of Example 1 as the cladding layer and the copper-based alloys of Comparative Examples 8 to 10 are shown in FIG. 6 (test temperature: 600° C.) and FIG. 7 (test temperature: 230° C. at the contact surface). At any of the test temperatures shown in FIGS. 6 and 7, the wear amount of the wear-resistant copper-based alloy of Example 1 was lower than those of the copper-based alloys of Comparative Examples 8 to 10.

<Morphology of Copper-Based Alloy>

Figure 2:
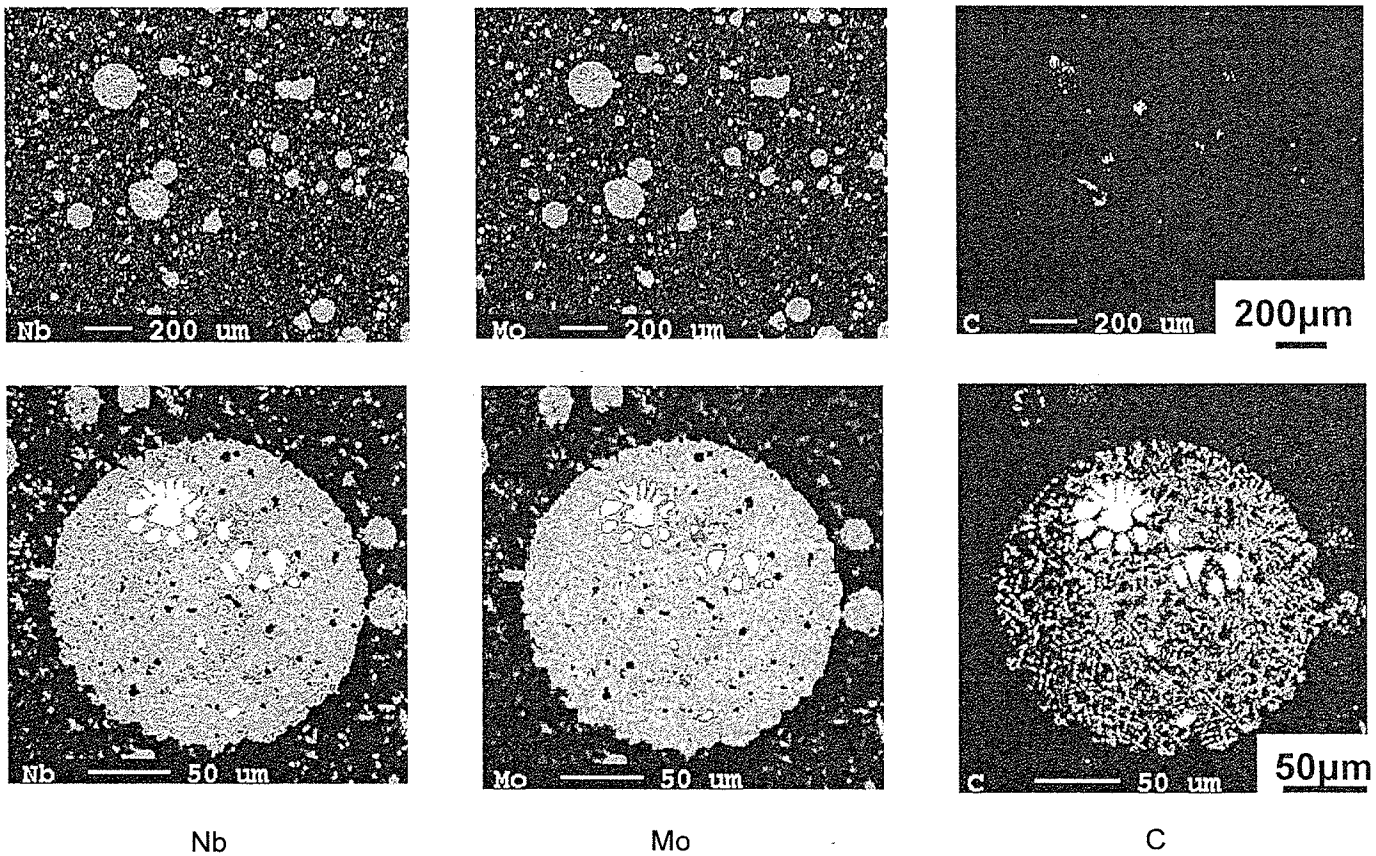
FIG. 2 is a view illustrating element mapping results through EPMA analysis in the embodiment of the copper-based alloy.

The inventors inspected the structure of the cladding layer of Example 1 using an EPMA analyzer. NbCMo was formed around NbC. The matrix forming the cladding layer was formed by including, as a primary element, a Cu—Ni-based solid solution and a mesh-like silicide including nickel as primary components. It was confirmed that a complex carbide of Nb and Mo was formed in the hard particles in the structure of the cladding layer of Example 1 (FIG. 2). The structure of the cladding layer of Example 1 was inspected using an X-ray diffractometer and was confirmed the matrix forming the cladding layer was formed by including, as a primary element, a Cu—Ni-based solid solution and a mesh-like silicide including nickel as primary components.

The copper-based alloy of the embodiment can be applied to a copper-based alloy that forms a sliding portion of a sliding member represented by a valve system member such as a valve seat or a valve in an internal combustion engine.

What is claimed is:

1. A wear-resistant copper-based alloy comprising:

at least one selected from the group consisting of molybdenum, tungsten, and vanadium;

niobium carbide;

copper;

chromium in an amount of less than 1.0% in terms of wt %; and a matrix and hard particles dispersed in the matrix, wherein the hard particles comprise niobium carbide and at least one selected from the group consisting of Nb—C—Mo oxide, Nb—C—W oxide, and Nb—C—V oxide around the niobium carbide.

2. The wear-resistant copper-based alloy according to claim 1, wherein the wear-resistant copper-based alloy comprises, in terms of wt %:

nickel: 5.0% to 30.0%;

silicon: 0.5% to 5.0%;

iron: 3.0% to 20.0%;

chromium: less than 1.0%;

niobium carbide: 0.01% to 5.0%;

at least one selected from the group consisting of molybdenum, tungsten, and vanadium: 3.0% to 20.0%; and the balance is copper and unavoidable impurities.

3. The wear-resistant copper-based alloy according to claim 1, wherein the wear-resistant copper-based alloy does not include chromium.

4. The wear-resistant copper-based alloy according to claim 1, wherein the amount of chromium is more than 0% and less than 1.0%.

5. The wear-resistant copper-based alloy according to claim 1, wherein an amount of cobalt is less than 2.0%.

6. The wear-resistant copper-based alloy according to claim 5, wherein an amount of molybdenum is 10% or less.

7. An object comprising a cladding layer, the cladding layer being made of the wear-resistant copper-based alloy according to claim 1.

8. A valve system member for an internal combustion engine, which is made of the wear-resistant copper-based alloy according to claim 1.

9. A sliding member for an internal combustion engine, which is made of the wear-resistant copper-based alloy according to claim 1.

* * * * *